United States Patent [19]

Strasser et al.

[11] 3,941,675

[45] Mar. 2, 1976

[54] BIPOLAR MULTIPLE ELECTROLYTIC CELL COMPRISING A DIAPHRAGM AND ELECTRODE FOR SAME

[75] Inventors: Bernd Strasser, Hamm; Wolfgang Kramer, Herdecke; Luciano Mosé, Dortmund; Helmut Hund, Schneidhain, all of Germany

[73] Assignee: Friedrich Uhde GmbH, Dortmund, Germany

[22] Filed: Mar. 26, 1974

[21] Appl. No.: 454,949

Related U.S. Application Data

[63] Continuation-in-part of Ser. No. 292,328, Sept. 26, 1972, abandoned.

[30] Foreign Application Priority Data

Sept. 28, 1971 Germany ..... 2148337

[52] U.S. Cl. ..... 204/256; 204/268; 204/290 F

[51] Int. Cl.[2] .. B01K 1/00; B01K 3/06; C01B 11/26

[58] Field of Search ..... 204/254, 268, 290 F, 256; 117/130 E, 230

[56] References Cited

UNITED STATES PATENTS

| | | | |
|---|---|---|---|
| 3,441,495 | 4/1969 | Colman | 204/268 |
| 3,716,462 | 2/1973 | Jensen | 204/38 B |
| 3,738,849 | 6/1973 | Bellis | 117/130 E X |
| 3,759,813 | 9/1973 | Raetzsch et al. | 204/268 X |
| 3,826,733 | 7/1974 | Schultz et al. | 204/290 F |

OTHER PUBLICATIONS

Lowenheim, F. A. *Electroplating*, In *Encyclopedia of Chemical Technology*, Ed. by R. E. Kirk et al. Vol. 8, 1965, pp. 69–70.

*Primary Examiner*—Howard S. Williams
*Assistant Examiner*—A. C. Prescott
*Attorney, Agent, or Firm*—Malcolm W. Fraser

[57] ABSTRACT

A bipolar multiple electrolytic cell having an alkali-chlorine diaphragm cell for obtaining caustic solution, chlorine and hydrogen in which the titanium metal electrodes act on one side as the anode and on the other as the cathode, the anode side being coated with a metal or metal oxide for activation purposes, and the cathode side having a dense coating of metal alloy of nickel and elements of the Group III or V of the periodic system, which is applied chemically, preferably by employing the so-called "Kanigen" process.

7 Claims, 6 Drawing Figures

BIPOLAR MULTIPLE ELECTROLYTIC CELL COMPRISING A DIAPHRAGM AND ELECTRODE FOR SAME

CROSS REFERENCE TO RELATED APPLICATION

This application consitutes a continuation-in-part of application, Ser. No. 292,328, entitled BIPOLAR MULTIPLE ELECTROYLTIC CELL COMPRISING A DIAPHRAGM, filed Sept. 26, 1972 now abandoned.

BACKGROUND OF THE INVENTION

The invention relates to a bipolar multiple electrolytic cell comprising a diaphragm for the decomposition of alkali-halogenide solutions into lye, halogenide and hydrogen. In particular, the improved construction relates to electrical alkali-chlorine diaphragm cells for obtaining caustic solution, chlorine and hydrogen.

Electrolytic cells of this kind are required to be compact, to be of simple construction, to be capable of carrying a heavy electrical load and thus to be very economical in use. Since the media passing through the electrolytic cell are particularly aggressive, chemically and/or physically, the material of construction must be resistant, and a form of construction is needed that meets the requirements.

Various constructions of multiple electrolytic cells are known in which the electrodes are bipolar and use is made of a diaphragm. In these types of cell the bipolar electrode consists of a metal structure with a diaphragm applied thereto. Thus, for example, the bipolar electrode shown in FIG. 5 of German Pat. No. 1,421,041, as laid open, consists of a sheet of titanium which is coated on the anode side with a noble metal such as platinum, while its other side is uncoated and comprises small projections through which it is connected electrically to a wire mesh, the chamber so formed constituting the cathode. The outer surface of the wire mesh is covered with an asbestos fibre cloth which constitutes the diaphragm. Even distribution of the current in the electrolyte and uniform flow of current in the electrode cannot be achieved with a bipolar electrode of this kind. The uniformly distributed current flowing from the electrode side of the anode, coated with noble metal, passes through the anolyte and the asbestos diaphragm into the wire mesh and from here travels by way of the individual projections on the titanium electrode into the titanium sheet itself and then to the coating of noble metal. The point of contact at the small projections poses a problem. Furthermore, because of the many point contacts at the places where the wires cross, a wire mesh in addition offers resistance to the flow of electric current. The corrosive media in the cell furthermore lead to breaks in contact in the wire mesh through oxide formation. The titanium electrode, unprotected on the cathode side, is exposed to hydrogen and becomes brittle after a short time.

According to German Pat. Nos. 1,592,020 and 2,030,610, as laid open, a bipolar electrode is constituted by a carrier plate, which also acts as a partition for the individual cells, by a plurality of anode plates on one side of the carrier plate, and by a plurality of cathode fingers on the other side of the carrier plate. The anodes are made of a suitable chlorine-resisting material, and the cathodes, which are in the form of metal wire or lattice work structures, are made of iron, nickel or chromium, or of a metal which resists the hydrogen and alkaline compounds. The metal wire mesh is fixed on the carrier plate by means of a supporting device and is covered with a cloth of asbestos fibre which acts as a diaphragm. In order to be able to accommodate the greatest possible area of electrode in a given space, the anode and cathode parts of the electrodes are of comb-like structure and in the assembled condition they extend into each other without touching. Bipolar electrodes of this construction are complicated, comprise a large number of contact points endangered by corrosion, and exhibit uneven current distribution and long current paths in the conductor material, in the anodes and the cathodes, since the electric current passes through some of these in the longitudinal and not the transverse direction. The repair and maintenance of bipolar electrodes of the known construction are not without their problems on account of the many individual parts in each electrode and the inability to check the contact points during use.

Electrodes covered by a coating of an alloy, e.g. steel or titanium, have been used in electrolytic cells. The coating is performed by electroplating. The coating material is a non-ferrous metal, mostly an alloy (see table II of U.S. Pat. No. 3,291,714). The coating alloys according to prior art consist of two or more metals and these inventions are based on the idea that an electrode made from metal, iron or titanium, must be covered by a coating of pure metal or an alloy, which consists of pure metals only and does not contain any metalloids, in order to guarantee an optimum current flow through the electrode. In the above U.S. patent, alloys of molybdenum, nickel, cobalt and tungsten are preferably used for the coating by electroplating.

These alloys of pure metals cannot meet the requirements of the surface of an electrode, which is used for obtaining caustic solution and hydrogen, i.e.

a. a non-porous coating on the cathode side must be guaranteed to prevent diffusion of gaseous or atomic hydrogen and caustic solution which usually can be found on the cathode in concentrations of 5 to 30 percent;
b. the coating must be sufficiently "dense" to prevent diffusion of atomic hydrogen;
c. corrosion protection must be optimum with regard to the following solutions:
   Na OH — 20 percent approx.
   Na Cl — 0.1 – 2 percent approx.
   hypochlorite in small quantities
d. the coating must be electrochemically suitable for obtaining hydrogen from aqueous solutions, particularly from aqueous caustic solution;
e. the coating must be very thin, approximately 0.2 – 1 mm.

The electrodes that are already known meet the requirements of (d) and (c), as the coating on the cathode side is of pure metal or pure metal alloys. However, because of their metallic construction, they cannot adequately meet the requirements of (a), (b), and (c). Additionally, the electroplated galvanic coating has the disadvantage of a non-uniform electric field and uneven or even disengaged coating.

SUMMARY OF THE INVENTION

The object of the present invention is to overcome the disadvantages of the devices normally used heretofore.

According to the invention, this object is achieved by the cathode side being constituted by that side of the titanium sheet entirely coated with a metal or a metal alloy. Suitable metal for the cathode side is, in particular, nickel alloyed with elements of group III or V of the periodic system, that are resistant to hydrogen and the catholyte. According to a further feature of the invention, and for the purpose of achieving a good seal against the exterior and a large effective area for the electro-chemical reaction, for given external dimensions of the multiple electrolytic cell, the metal electrodes are smooth in the area of the frame and are profiled in the area of the reaction chamber. The profiling of the metal electrodes may be such that the distance from one electrode to the next is the same at each point, or that the projections and recesses on and in two neighboring metal electrodes are positioned opposite each other. If required, the metal electrode and the multiple electrolytic cell can be so formed that the projections on the metal electrodes support the diaphragm fitted between them.

The advantages achieved by the invention are, in particular, that the metal electrode of the invention does not comprise contact points endangered by corrosion, provides even distribution of current and is thus capable of carrying a heavy electro-chemical load whilst requiring little space for the purpose. The necessary spaces for the discharge of gas are not affected because the profiling is of the required expedient form. From the standpoint of mechanical construction, the metal electrode spacings which are responsible for the electrolytic resistance can easily be set and maintained.

The prejudice that the coating on the cathode side must be of pure metal or pure metal alloy has been overcome. It was found that a coating of a nickel alloy, which contains 7 to 10 % phosphorous and was chemically applied according to the Kanigen process, is able to meet all requirements of an electrode.

Kanigen is the trademark of General American Transportation Corporation in respect of a chemical nickel plating process. It is well known to those skilled in the art, and is a continuous process for assuring the deposition of a uniform, non-porous coating of heavy specific weight and controllable density. Suffice it to say that in the plating solution the ions of nickel and of hypophosphite on the one hand and the pH value on the other are kept within the limits that correspond to the best conditions of deposition. Such solution, kept at a temperature of 55°C feeds one or more nickel plating tanks after being heated by a supply of steam to 98°C. When discharged from the plating tank, the solution is cooled to 55°C, automatically recharged, and filtered and then returned to a storage tank.

The coating is thin and has good electrochemical activity by virtue of the nickel content being 90 to 93 percent. The phosphorous atoms present in the coating have no adverse affect on the conductivity but do strongly impede the diffusion of hydrogen through the coating. Bipolar electrodes, nickel coated by the Kanigen process, were tested in a 0.1 $m^2$ pilot cell and found to be excellently suitable for decomposing concentrated common salt solutions to chlorine, hydrogen and caustic soda solution at temperatures of 20° to 90°C. The overpotential in electrochemical $H_2$ production was less than with an electroplated nickel coating. The corrosion resistance of the chemically applied nickel coating was twice to three times as good as that of the electroplated nickel coating. Likewise, there was no evidence of the solution penetrating below the coating nor of any subsequent disengagement of the coating.

DESCRIPTION OF THE PREFERRED EMBODIMENTS

Figure 1:
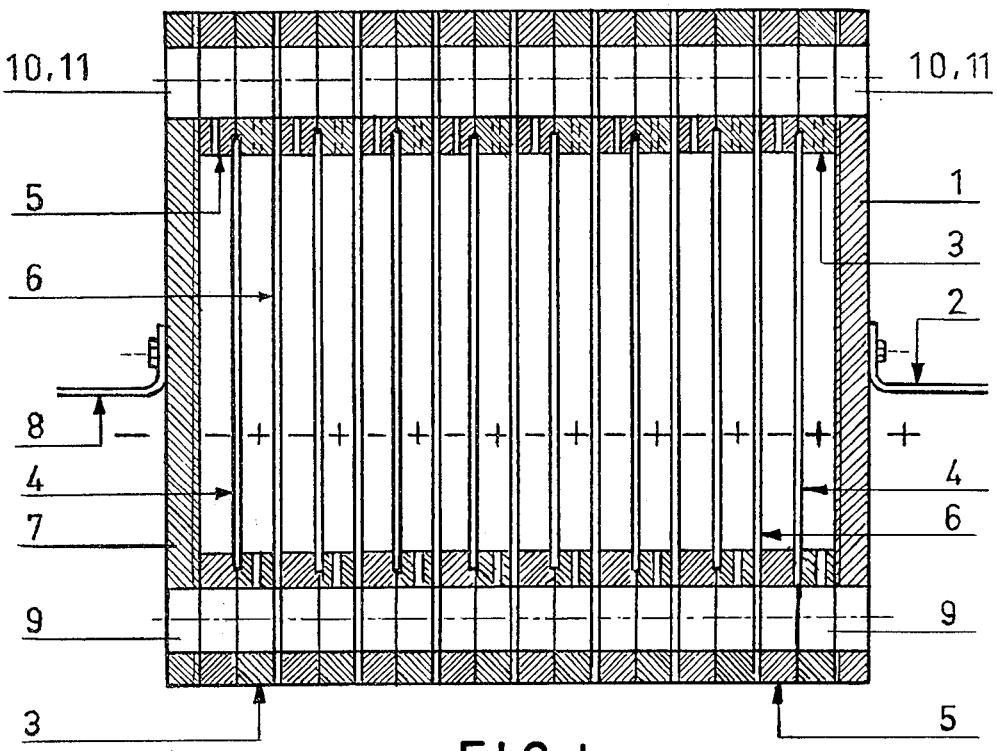
FIG. 1 is a longitudinal section through a bipolar multiple electrolytic cell.
Figure 2:
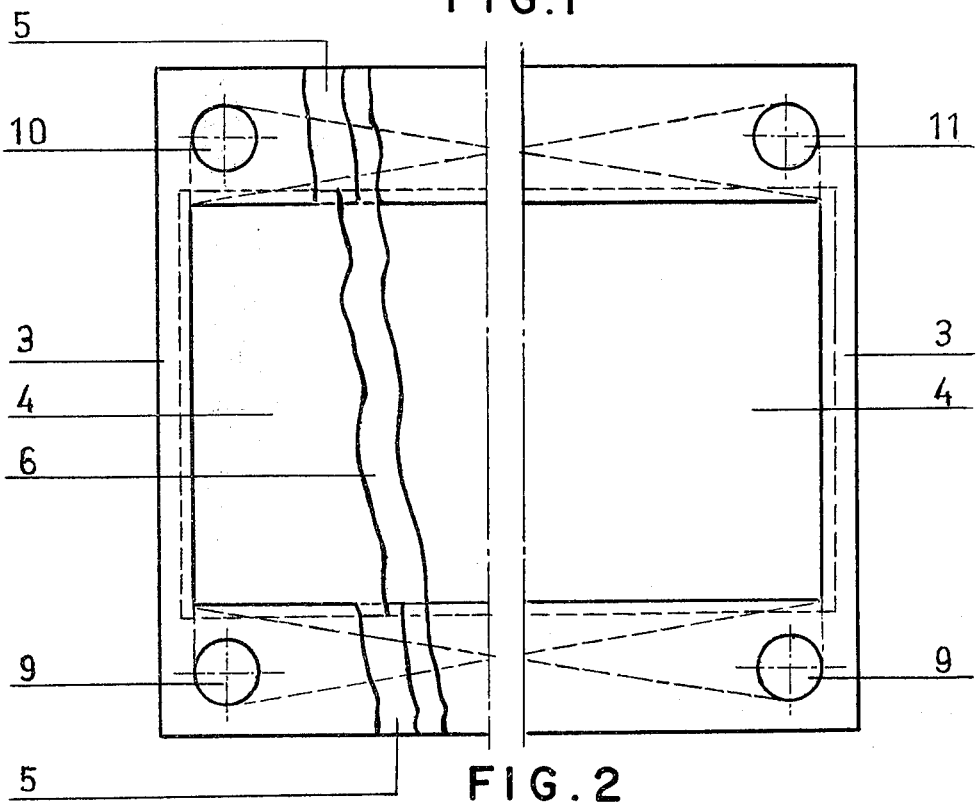
FIG. 2 is a cross section through the electrolytic cell illustrated in FIG. 1.

The multiple electrolytic cell illustrated in FIGS. 1 and 2 consists of a face plate 1 to which the current conductor 2 is attached. Disposed adjacent this face plate, which acts as an anode on the cell side, is the nonconducting frame 3. The frame is generally of such width as is required for spacing the diaphragm 4 which follows next. The diaphragm 4 is followed by a frame 5 which is adjoined by the first bipolar metal electrode 6 of the invention. A multiple electrolytic cell of the required length can be built up by repeating the assembly of frames, diaphragms, further frames and metal electrodes. The multiple electrolytic cell is closed off by a second face plate 7, the conductor 8 leading off this plate. The entire multiple electrolytic cell is held together by means of known clamping devices, such as tie rods, not illustrated. A fluid-tight seal is established by means of known sealing elements, not illustrated, fitted between the individual components such as the metal electrodes, the frames and the diaphragms. The frame 3 for the anolyte chamber contains a supply duct 9 for the electrolyte and a discharge duct 10 for the chlorine gas and the anolyte. The frame 5 for the catholyte chamber has a discharge duct 11 for the catholyte and the hydrogen.

Figure 3:
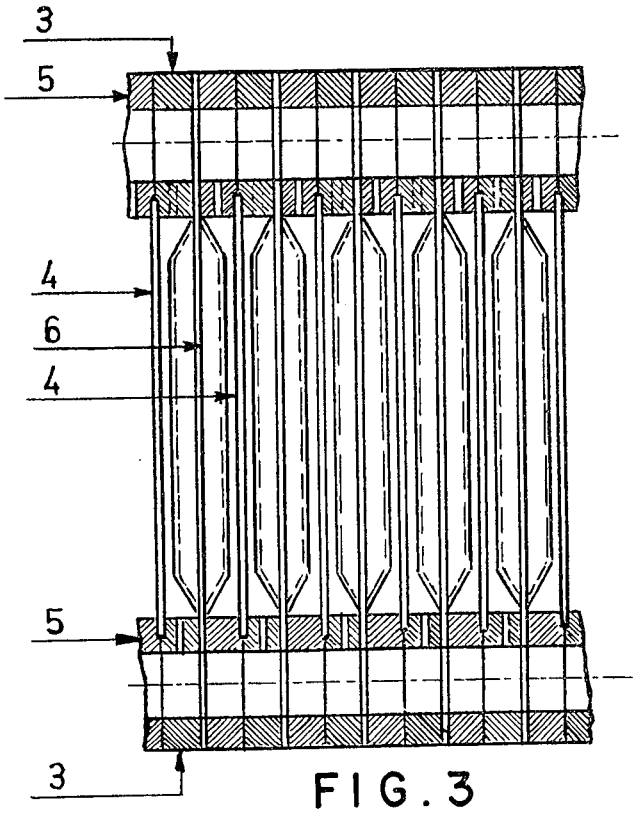
FIG. 3 shows a cross section illustrating profiled electrodes.
Figure 4:
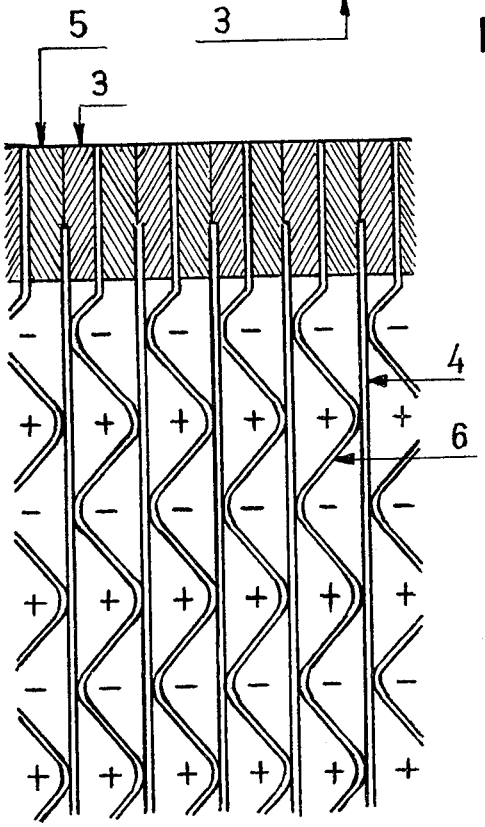
FIG. 4 is a horizontal section through one form of electrode.
Figure 5:
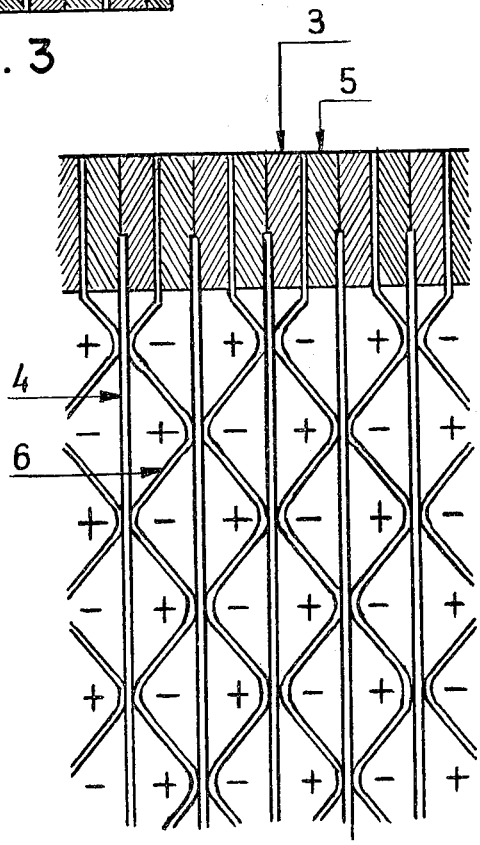
FIG. 5 is a horizontal section through a further form of the electrode.

The metal electrodes illustrated in FIGS. 3, 4 and 5 show on the one hand a possible form of profiling, and on the other the manner in which two opposite metal electrodes are arranged.

Figure 6:
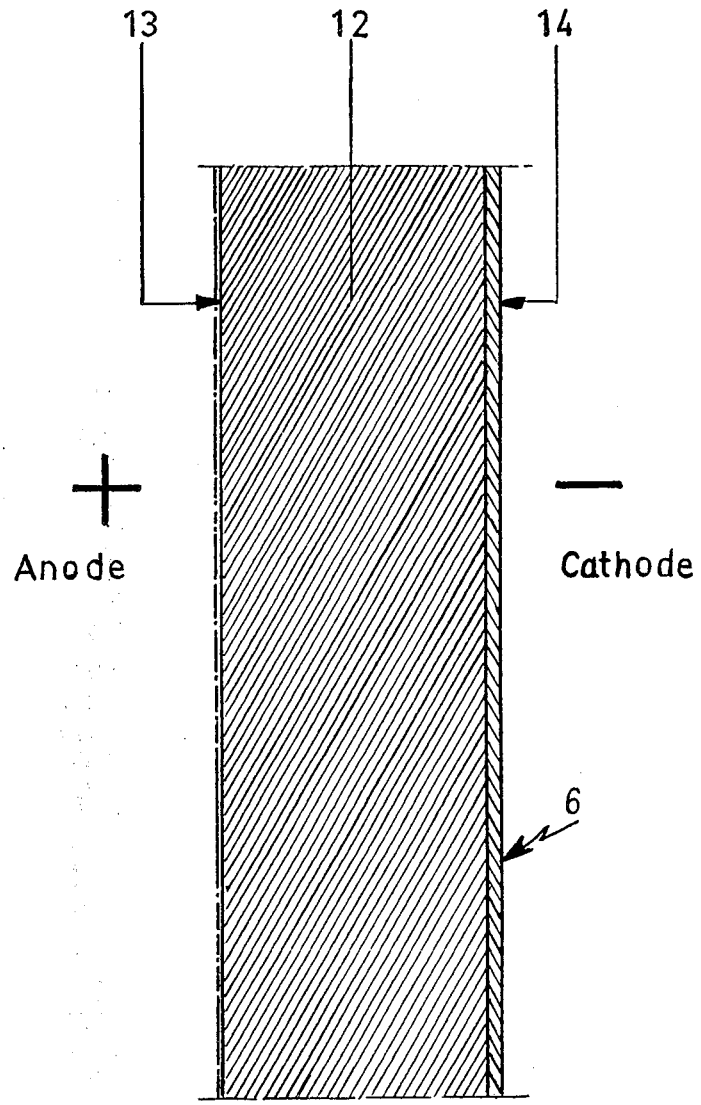
FIG. 6 is a cross section, on an enlarged scale, through a metal electrode.

In the cross section through a portion of the metal electrode of the invention illustrated on an enlarged scale in FIG. 6, the numeral 12 designates the titanium sheet which is covered on the anode surface with an activating layer 13 of metal or metal oxide. Platinum, for example, may be employed as the activating layer. This activating layer should be as dense as possible so that no inactive areas are left. It need not however be absolutely dense, since the uncovered titanium oxidizes immediately and is resistant to anolyte and chlorine. The application of the activating layer on the anode side of the titanium sheet can be achieved by a number of methods. The activating layer is only necessary in the surface zone wetted by the anolyte, since the electro-chemical processes take place here.

The metal or metal alloy layer 14 applied to the cathode side however, is non-porous and of such thickness and extent that it covers the surface of the titanium closely and completely. A preferred coating for the cathode side is a nickel alloy containing phosphorous or boron or another element of the 5th or 3rd group of the periodic system. The catholyte and hydrogen thus do not come in contact with the titanium sheet. The nickel alloy layer is applied to the cathode side by purely chemical means, such as the Kanigen process. In accordance with that process, the nickel coating, thus applied to cathode, usually contains 7 to 10 % phosphorous or boron or another element of the 5th or 3rd group, which modifies the nickel structure making it less permeable to $H_2$. The coating thus applied may be described as a dense metallic coating. Consequently, hardly any $H_2$ diffuses toward the titanium plate and the coating does not disengage, which otherwise would reduce the current flow. The coating applied chemically in this fashion is almost non-porous and the corrosion protection is optimum.

The metal alloy layer must adhere so firmly to the titanium sheet that despite profiling of the metal electrode, the required electrical contact between the two metals is ensured over the entire surface. Since the coating on the cathode side extends over the entire surface, reduction of the contact areas cannot take place as a result of chemical or physical attack by the reaction media.

The profiling of the metal electrode of the invention is not limited to a one dimensional periodic arrangement, e.g. linear undulations, but may also be two dimensional, e.g. in the form of rows and files of small projections. Spaces in which the rising chlorine and hydrogen might build up should, however, be avoided.

Cells of the type described herein and comprising metal electrodes can also be used as fuel cells. In this case, the two words anode and cathode are transposed as regards their meaning, and the reaction media are other than alkali-halogenide mixtures. However, the use of such cells as fuel cells is optional and is not to be construed as a limiting feature of the invention.

What we claim is:

1. A bipolar multiple electrolytic cell comprising a diaphragm for decomposing alkali-halogenide solutions, and in which the cells, electrically connected in series, are formed by a continuous series of planar metal electrodes, frames, diaphragms and further metal electrodes, the metal sheet electrodes acting on one side as the anode and on the other as the cathode, and the anode side being of titanium coated with a metal or metal oxides for activation purposes, the improvement comprising a metallic coating closely and completely covering and bonded to that side of said sheet constituting the cathode and applied chemically, said coating comprising an alloy of nickel and elements of group III or V of the periodic system.

2. A cell as claimed in claim 1, in which the nickel alloy coating on the cathode side contains 7 to 10% phosphorous and 90 to 93% nickel.

3. A cell as claimed in claim 1, in which the nickel alloy contains 7 to 10% boron and 90 to 93% nickel.

4. A cell according to claim 1 in which the metal compound on the cathode side contains between 7 and 10% phosphorous.

5. A cell according to claim 1 in which the metal compound on the cathode side contains between 7 and 10% boron.

6. In a bipolar multiple electrolytic cell comprising a diaphragm for decomposing alkali-halogenide solutions and in which the cells are electrically connected in series and are formed by a continuous series of metal sheet electrodes, frames, diaphragms and further metal sheet electrodes, the metal sheet electrodes acting on one side as an anode and on the other side as the cathode, and the anode side being of titanium coated with a metal or metal oxide for activation purposes.

the improvement comprising a chemically applied metallic coating closely and completely covering and bonded to the cathode side of the sheet, the metallic coating comprising between 90 and 93% nickel and between 70 to 10% of an element chosen from the third or fifth group of elements in the periodic system.

7. A cell according to claim 6 wherein said element is chosen from the group consisting of phosphorous and boron.

* * * * *